US005775965A

United States Patent [19]

Hango

[11] Patent Number: 5,775,965

[45] Date of Patent: Jul. 7, 1998

[54] LEASH RELEASE MECHANISM FOR SURFBOARDS AND THE LIKE

[75] Inventor: Joseph W. Hango, Brea, Calif.

[73] Assignee: Surf More Products, Inc., San Clemente, Calif.

[21] Appl. No.: 780,635

[22] Filed: Jan. 8, 1997

[51] Int. Cl.[6] ..... A63C 15/06

[52] U.S. Cl. ..... 441/75; 441/74

[58] Field of Search ..... 403/379, 315, 403/316; 441/74, 75

[56] References Cited

U.S. PATENT DOCUMENTS

| | | | |
|---|---|---|---|
| 2,484,401 | 10/1949 | Coie | 403/379 |
| 3,549,160 | 12/1970 | Etzkorn | 403/379 |
| 4,234,990 | 11/1980 | Colburn | 441/75 |
| 4,610,634 | 9/1986 | Kimura | 441/75 |
| 5,243,710 | 9/1993 | Craycroft | 2/312 |

*Primary Examiner*—Ed L. Swinehart

*Attorney, Agent, or Firm*—John E. Vanderburgh

[57] ABSTRACT

A device for quickly releasing a surfboard tether from a body strap. The tether and surfboard are normally connected by a plug and socket swivel connection. The device comprises a removable locking pin which, in its locked position, extends through openings in the socket and through a passage in the plug to secure the plug and socket connection. A resilient retainer acts against the socket body and the locking pin to normally retain the locking pin in its locked position. The locking pin is adapted to be pulled out of the passage and socket body against the urging of the resilient member to release the plug and socket, thereby disconnecting the leash from the body strap. In one embodiment of the invention the resilient member comprises an elastomeric band which is looped around the locking pin and the socket body and acts against a surface of the locking pin provided for that purpose to urge the locking pin into the locked position to hold the plug and socket in connection. In another embodiment of the invention, the resilient member comprises a clip having a pair of spaced apart spring arms and a centrally located locking pin between the spaced arms.

5 Claims, 2 Drawing Sheets

FIG. 1
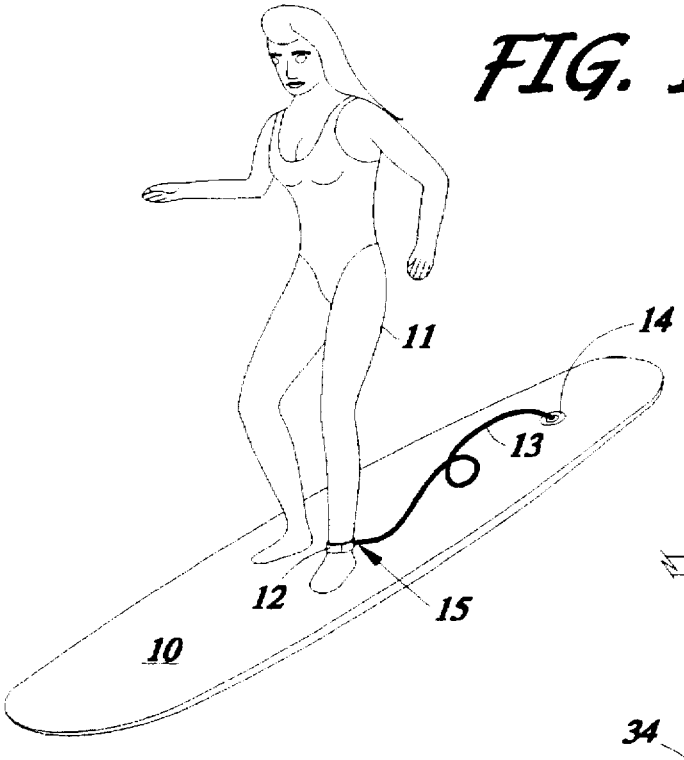
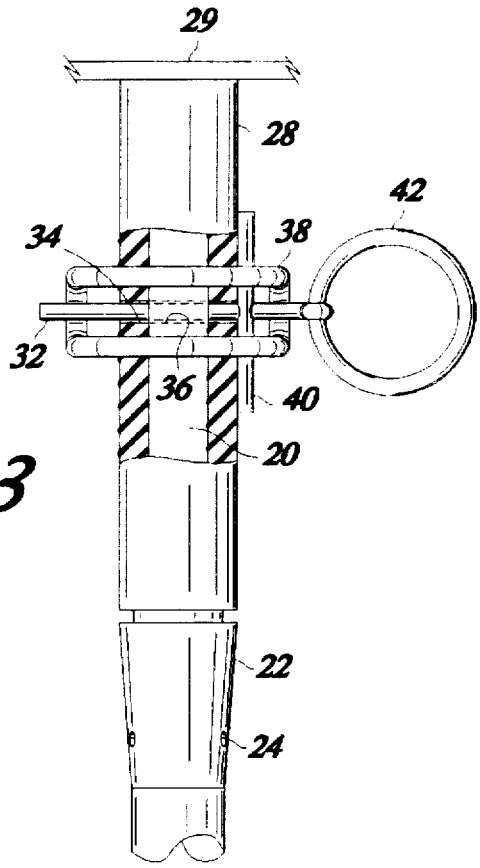
FIG. 3
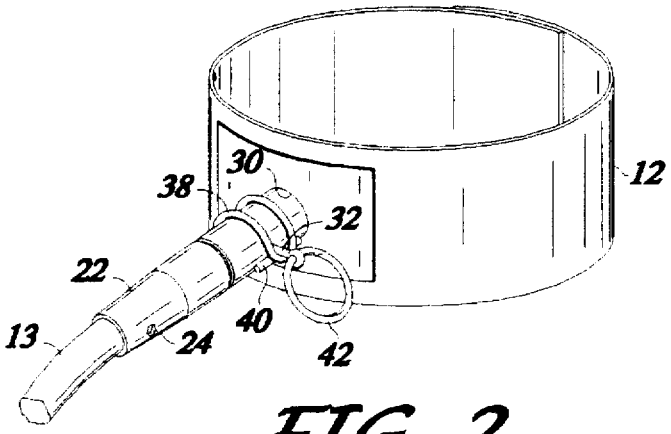
FIG. 2

LEASH RELEASE MECHANISM FOR SURFBOARDS AND THE LIKE

FIELD OF THE INVENTION

This invention relates to surfboard leashes and more particularly release mechanisms for quickly disconnecting the leash from the surfboard.

BACKGROUND OF THE INVENTION

In the sport of surfboarding, the surfboard is normally connected to the ankle of the rider by an ankle cuff and leash combination which prevents the surfboard from being lost in the event the rider falls off of the surfboard. More recently, in the sport of snowboarding, similar leash devices have been used to connect the snowboard to the ankle of the rider so that the snowboard does not continue down the slope in the event the rider should fall.

Under certain circumstances, however, it is essential to quickly disconnect the leash so that the operator is free of any connection to the surfboard or snowboard. For example, on occasion, serious injury can occur when and if the surfboard or snowboard operator becomes entangled with the leash such as may occur in a severe fall.

Several quick release designs are available in the prior art. For example, U.S. Pat. No. 4,234,990, Colburn, discloses a quick disconnect mechanism for a surfboard leash which includes a yoke, to which the leash is attached, which is attached to the ankle cuff by means of a releasable pin. U.S. Pat. No. 5,243,710, Craycroft likewise discloses a quick release mechanism in which a body strap is provided with an anchoring station carrying a downwardly extending pin which extends through apertures in a socket which is rigidly attached to the body strap. These devices can be used only with specially configured leash and strap combinations and are not adaptable for retrofitting surfboard and leash combinations which use plug and socket connectors to connect the leash to the body strap.

SUMMARY OF THE INVENTION

In accordance with the present invention a quick release mechanism is provided for attaching the leash to a body strap. The mechanism of the present invention is readily adaptable for retrofit on the existing plug and socket connectors and can be provided with new leash and strap combinations with minimal changes in manufacturing procedures. The device of the present invention can be readily operated under emergency or adverse conditions to quickly release from the leash.

As is conventional, a leash is attached to a body strap using a plug and socket swivel connection which is adapted to permit the leash and body strap to pivot or swivel with respect to one another. The socket is formed in a body carried by the leash or by the body strap for receiving the plug. The plug and socket swivel connection is conventional in the art and is not per se a part of the invention. However, the device of the present invention provides a quick release without loss of the swivel feature of the leash connection to the body strap.

In accordance with the invention the leash or tether is connected to the body strap, such as an ankle cuff, by the plug which is received in the corresponding socket. The plug includes a through running passage which extends normal to the longitudinal axis of the plug. When the plug is seated in the socket, the passage is aligned with the opposed openings in the socket body. The plug is secured in the socket by a removable locking pin which, in its locked position, passes through the openings in the side wall of the socket and through the passage in the plug. A resilient retainer acts against the socket body and the locking pin to normally retain the locking pin in its locked position. The locking pin is adapted to be pulled out of the passage and socket body against the urging of the resilient member to release the plug and socket, thereby disconnecting the leash from the body strap. Preferably, means are provided to tether the locking pin to the body strap so that it does not become lost when removed from the plug and socket.

In one embodiment of the invention the resilient member comprises an elastomeric band which is looped around the locking pin and the socket body and acts against a surface of the locking pin provided for that purpose to urge the locking pin into the locked position to hold the plug and socket in connection. In another embodiment of the invention, the resilient member comprises a clip having a pair of spaced apart spring arms and a centrally located locking pin between the spaced arms. When in the locked position the arms act to retain the clip on the socket body and hold the locking pin in its locked position. The clip and locking pin are removed from the socket body by pulling on the locking pin to cause the arms to ride over the body of plug and socket forcing them apart and allowing removal of the locking pin from its locked position in the plug and socket to release the leash from the body strap.

Other advantages and features of the invention will become apparent from the following description of the invention taken in conjunction with the drawings.

BRIEF DESCRIPTION OF THE DRAWINGS

FIG. 1 is a perspective view of a surfer on a surfboard utilizing a leash line with the quick release device in accordance with the present invention;

FIG. 2 is a perspective view, partially broken away for compactness of illustration, of a leash connected to a body strap utilizing one embodiment of the device of the present invention;

FIG. 3 is a top plan view, partially broken away for compactness of illustration and partially in section, of the device of FIG. 2 illustrating the device in the connecting mode;

DESCRIPTION OF THE INVENTION

Figure 4:
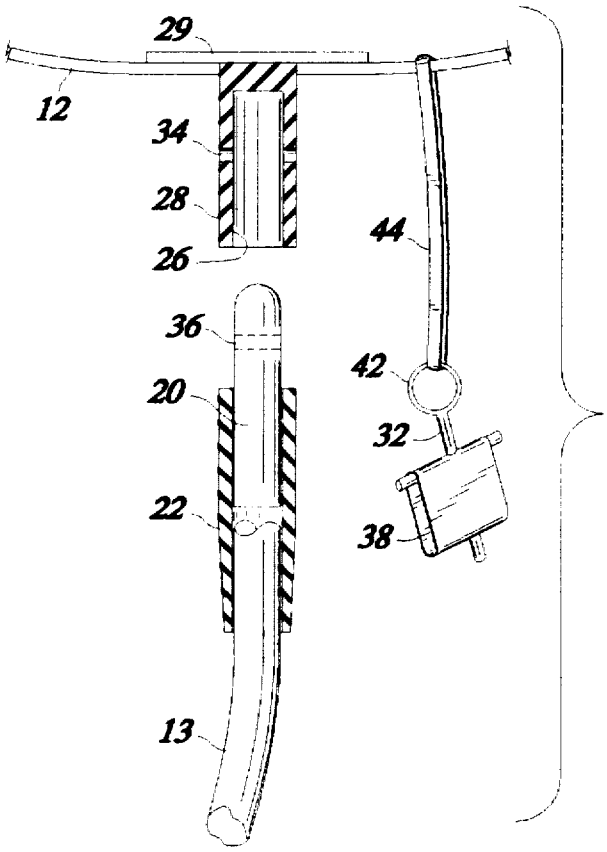
FIG. 4 is a top plan view of the components of the device of the invention in the released mode and showing another form of resilient band.

Referring to FIG. 1, there is illustrated a typical surfboard 10 and surfer 11 riding the board. An ankle leash in the form of an ankle cuff 12 and tether line 13 is provided. One end of the tether line 13 being connected to the surfboard 10 as at 14 and the other end connected to the cuff 12 by means of a quick release device designated generally at 15.

As previously described, the foregoing combination enables a surfer to retrieve his surfboard should he become separated from it in normal surfing activities. The present invention provides for a quick disengagement of the tether line 13 from the ankle cuff 12 should the surfer becomes involved in abnormal or an emergency operation. In addition, it allows for the easy disconnection of the tether line 13 when the surfer is unsure and wishes to move about without removing the ankle cuff 12. The device 15 of the present invention provides for the ready reattachment of the tether line 13 when the surfer is ready to take to the water. These features are provided by the quick release device 15 without loss of the swivel feature of the plug and socket connection.

Referring now to FIG. 2 and FIG. 3 there is illustrated the ankle cuff 12 and a tether line 13 connected for normal operation. A plug 20, is secured to an end of the tether line 13 opposite the end connected at 14 to the surfboard 10. The plug 20 is retained in a body 22 by set screws 24. The end of the tether line 13 is secured in the body 22 by means of a suitable bonding agent or is inserted in the body during the molding operation to securely bond the end of the tether 13 in the body. The plug 20 is received in a socket 26 defined in a receptacle 28 which includes a base 29 which is secured to the ankle cuff 12 by being sewn between two layers of cuff material, the outer layer of which is provided with a suitable opening 30 through which the receptacle 28 extends. The plug 20 is retained in a locked connective position in the socket 26 of the receptacle 28 by means of a locking pin 32 which extends through openings 34 in the receptacle 28 and a through-running passage 36 in the plug 20 and which is held in position by a resilient elastomer band 38 which acts against the suitable surface 40 on the locking pin 32 to retain the locking pin 32 in the openings to securely lock the locking pin 32 in the plug 20.

The device 15 is shown in more detail in its locked mode in FIG. 3. As shown, the locking pin 32 includes a cross arm which provides the surface 40 against which one end of the elastomer band 38 acts to retain the pin 32 in a locked position. One end of the locking pin 32 is provided with a ring 42 which allows the operator to grasp the end of the locking pin 32 to pull it to release the tether 13 from the ankle cuff 12. The grasping device 42 may be a ball or, preferably, a ring, as illustrated.

The elastomer band 38 may take several forms, the preferred form being an O-ring or other elastic annulus, such as a rubber band, which is stretched and looped over each end of the locking pin 32 and the upper portion of the receptacle 28 to act against the surface 40 defined by the cross arm of the locking pin to retain it in position. The locking pin 32 is removed by grasping the ring 42 and pulling against the action of the elastomer band. Once the end of the locking pin 32 is withdrawn into the opening 34 in the receptacle, the elastomer band is released and the locking pin is free to be withdrawn from the passage 36 and the receptical to release the tether line 13 from the ankle cuff 12.

Alternatively, the resilient band may comprise a generally tubular elastomer body which is provided with suitable openings through which the locking pin 32 can extend and which, in the locked position, completely surrounds the receptacle 28 and the cross arm of the locking pin 32. To release the tether line 13, the locking pin 32 is moved out of the aligned openings 34 in the receptacle 28 and the passage 36 in the plug 20 by pulling against the elastomer band 38 until the end of the locking pin 32 clears both of the the aligned openings whereupon the tether line 13 and plug 20 are released from the receptacle 28 and cuff 12 as illustrated in FIG. 4.

Although not essential to the invention, it is highly preferred to provide a second tether 44 for the locking pin 32 so that when it and the elastomer band 38 are separated from the plug 20 and receptacle 34, the locking pin 32 and elastomer band 38 remain attached to the ankle cuff 12. The locking pin tether 44 may be a single cord sewn on to the ankle cuff 12 or, more simply, a resilient O-ring of sufficient diameter to loop around the ankle cuff 12 and through the grasping ring 42 of the locking pin 32.

Figure 5:
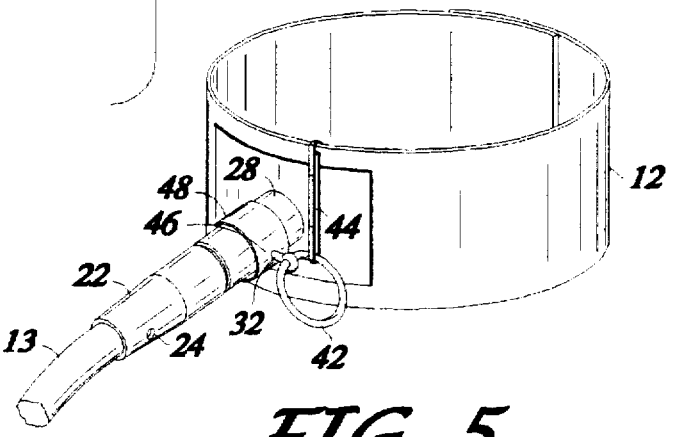
FIG. 5 is a perspective view, partially broken away for compactness of illustration, of a leash connected to a body strap utilizing a spring clip embodiment of the device of the present invention.
Figure 7:
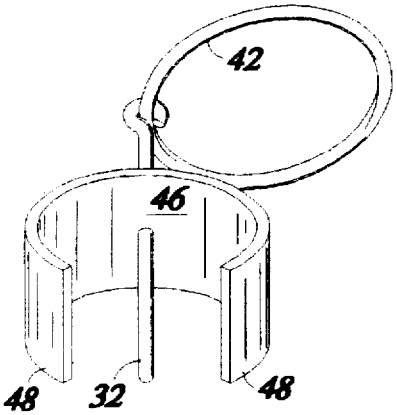
FIG. 7 is a perspective view of the clip end of the device of FIG. 6.
Figure 6:
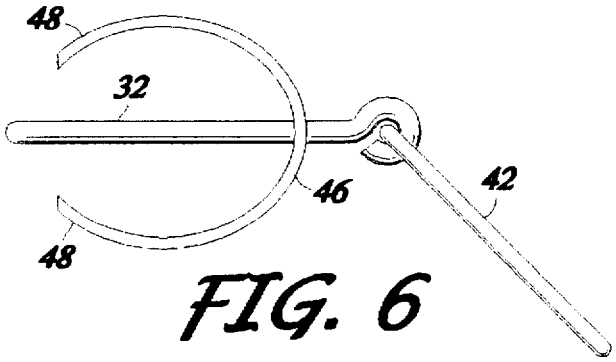
FIG. 6 is a side view of the embodiment of FIG. 5.

FIGS. 5 and 6, in which like reference numbers denote like parts, illustrate another embodiment of the disconnect device 15 of the present invention. As illustrated, the device 15 includes the locking pin 32 having a ring at one end and a free end designed for insertion into the passage 36 of the plug 20 through the aligned openings 34 of the receptacle 28. The locking pin 32 extends through the wall of a spring clip 46 which is defined by a tubular body having a portion of its side wall cut away so that the remaining wall portion defines a spaced apart pair of arms 48 joined at one end. In this embodiment of the invention the provision of a cross arm for the locking pin is not essential. The clip body is formed of a spring like material such as spring steel or, more preferably, a resilient plastic. The I.D. of the clip is dimensioned to receive the receptacle 28 and the opening form between the spring arms is less than the outside diameter of the receptacle so that as the locking pin 32 is inserted into the opening 34 of the receptacle, the spring arms are forced apart and, as a result of the spring action of the clip 46, the arms 48 normally urge against the receptacle to retain the locking pin 32 in the passage 36 of the plug 20. The locking pin 32 can be removed to release the plug 20 from the socket 26 of the receptacle 28 by grasping the ring and pulling thereby to force the spring arms 48 apart and cause them to ride over the plug body while the locking pin 32 is removed from the passage 36 in the plug 20 and from the receptacle thereby to release the tether 13 from the body strap 12.

The quick release device of the present invention is readily adapted to be used with the conventional swivel type connections currently being used to connect a tether to a body strap. The device securely retains the tether to the body strap but can be conveniently operated to allow the user to disconnect the tether from the body strap, particularly in the event of an emergency situation. Once disconnected, however, the tether can be easily and conveniently reconnected and securely locked to the body strap by the device of the present invention. The device of the invention can be readily fitted on existing leashes making the quick release feature of the invention available as an after market item.

While the foregoing is a description of certain preferred embodiments of the invention, it will be understood by those skilled in the art that various arrangements which lie within the spirit and scope of the invention other than those described in detail in the specification will occur to such persons. It is therefore to be understood that the invention is to be limited only by the claims appended hereto.

Having defined the invention,

I claim:

1. A tether device for a surfboard comprising:

a. a flexible line adapted to be secured at one end to a surfboard, said line carrying a plug at its opposite end, said plug having a passage extending perpendicularly to the longitudinal axis thereof;

b. a body strap for securement about a body part of a user of said tether device;

c. a receptacle secured to said body strap, said receptacle having side walls defining a socket for receiving said plug, said receptacle including aligned openings extending through said side walls thereof and being aligned with said passage in said plug when said plug is inserted in said socket;

d. a locking pin for insertion through said aligned openings of said receptacle and said passage of said plug to retain said plug in said receptacle thereby to secure said flexible line to said body strap when said locking pin is so inserted and for releasing said line from said body strap when said locking pin is removed; and e. retainer means for removably retaining said pin in said aligned openings of said receptacle and in said passage of said plug.

2. The tether device of claim 1 further including means for securing said locking pin to said body strap when said locking pin is removed from said receptacle and said plug.

3. The tether device of claim 1 wherein said locking pin includes a perpendicularly extending member medially disposed thereon defining a surface and said retainer consists of an elastomeric band defining an interior for receiving said receptacle and said surface of said locking pin, said elastomeric band acting against said receptacle and said surface of said locking pin to retain said locking pin in said receptacle and said passage of said plug.

4. The tether device of claim 1 wherein said retainer comprises retaining clip, said clip including a pair of spaced apart resilient arms surrounding said receptacle and acting there against to retain said clip on said receptacle, said locking pin extending through said clip and affixed thereto, said locking pin terminating beyond said spaced apart arms.

5. The tether device of claim 1 wherein said locking pin includes a pull for grasping said locking pin to withdraw said locking pin from said passage in said plug thereby to permit removal of said plug and from said receptacle for the quick release of said flexible line from said body strap.

* * * * *